US006275796B1

(12) United States Patent
Kim et al.

(10) Patent No.: US 6,275,796 B1
(45) Date of Patent: Aug. 14, 2001

(54) APPARATUS FOR QUANTIZING SPECTRAL ENVELOPE INCLUDING ERROR SELECTOR FOR SELECTING A CODEBOOK INDEX OF A QUANTIZED LSF HAVING A SMALLER ERROR VALUE AND METHOD THEREFOR

(75) Inventors: Moo-young Kim, Sungnam; Yong-duk Cho; Hong-kook Kim, both of Suwon, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/060,345

(22) Filed: Apr. 15, 1998

(30) Foreign Application Priority Data

Apr. 23, 1997 (KR) ..... 97-15044

(51) Int. Cl.[7] ..... G10L 21/00
(52) U.S. Cl. ..... 704/230; 704/226
(58) Field of Search ..... 704/219, 226, 704/230

(56) References Cited

U.S. PATENT DOCUMENTS

| | | | | |
|---|---|---|---|---|
| 4,975,956 | * | 12/1990 | Liu et al. | 704/227 |
| 5,012,518 | * | 4/1991 | Liu et al. | 704/227 |
| 5,414,796 | * | 5/1995 | Jacobs et al. | 704/221 |
| 5,451,951 | * | 9/1995 | Elliott et al. | 341/155 |
| 5,495,555 | * | 2/1996 | Swaminathan | 704/207 |
| 5,600,754 | * | 2/1997 | Gardner et al. | 704/221 |
| 5,664,055 | * | 9/1997 | Kroon | 704/223 |
| 5,680,508 | * | 10/1997 | Liu | 704/227 |
| 5,699,485 | * | 12/1997 | Sholam | 704/223 |
| 5,732,389 | | 3/1998 | Kroon et al. . | |
| 5,734,789 | * | 3/1998 | Swaminathan et al. | 704/206 |

* cited by examiner

*Primary Examiner*—Krista Zele
*Assistant Examiner*—Michael N. Opsasnick
(74) *Attorney, Agent, or Firm*—Burns, Doane, Swecker & Mathis, L.L.P.

(57) ABSTRACT

An apparatus for quantizing a spectral envelope with noise robustness showing high performance even under a background noise environment and a channel noise environment, and a method therefor, are provided. The spectral envelope quantizing apparatus includes a spectral envelope quantizing apparatus with noise robustness for representing a spectral envelope of speech by a minimum number of bits for the optimal coding of a speech signal. The apparatus includes a line spectrum frequencies (LSFs) input portion for converting linear predictive coding coefficients extracted from the speech into Nth order line spectrum frequencies coefficients and inputting the coefficients as the LSFs of a current frame. It also includes a linked split-vector quantizing portion for dividing the LSFs into a predetermined number of linked sub-vectors and quantizing the sub-vectors, and a predictive linked split-vector quantizing portion for obtaining the difference between the LSFs and the LSFs of a previous frame and vector-quantizing the difference. The apparatus further includes an error selector for comparing the error values of the LSFs quantized in the linked split-vector quantizing portion and the predictive linked split-vector quantizing portion, selecting the codebook index of the quantized LSFs having the smaller error value, and outputting the selected codebook index together with a mode bit.

8 Claims, 5 Drawing Sheets

APPARATUS FOR QUANTIZING SPECTRAL ENVELOPE INCLUDING ERROR SELECTOR FOR SELECTING A CODEBOOK INDEX OF A QUANTIZED LSF HAVING A SMALLER ERROR VALUE AND METHOD THEREFOR

BACKGROUND OF THE INVENTION

1. Field of the Invention

The present invention relates to optimal coding of a speech signal, and more particularly, to an apparatus for quantizing spectral envelope and a method therefor with noise robustness for optimally coding the speech signal, under all the environments in which channel errors are not generated and channel errors are generated, and a method therefor.

2. Description of the Related Art

Standardization of speech encoders is proceeding in the US, Japan, and Europe. Most encoders according to the standardization divide speech into a spectral envelope and an excite signal, quantize them, and transfer corresponding bit streams. Therefore, a method of designing a quantizer in which a spectrum envelope is represented by the minimum number of bits is essential. In order to represent the spectral envelope, a linear predictive coding (LPC) is extracted from the speech. In order to efficiently quantize the spectral envelope, the LPC coefficients are converted into line spectrum frequencies (LSFs).

Paliwal and Atal provided a split-vector quantizer (SVQ) in order to quantize the LSFs (refer to "Efficient Vector Quantization of LPC Parameters at 24 bits/frame." IEEE Trans, Speech, audio processing. Vol.1, no.1, pp.3–14, January 1993.). In this method, satisfactory performance is obtained from 24 bits/frame by dividing tenth order LSFs into two or three sub-vectors and separately quantizing the sub-vectors.

Meanwhile, a predictive split-vector quantizer (PSVQ) using an interframe correlation for improving the performance of the SVQ was provided in ITU-T Recommendation G.723.1.

However, this method has a shortcoming in that when a channel error is generated, the error affects the next frame. In order to prevent the error from affecting the next frame, de Marca provided a method of alternately using the SVQ and the PSVQ in odd and even frames. However, this method has lower performance than the PSVQ when no channel error is generated.

SUMMARY OF THE INVENTION

To solve the above problem(s), it is an objective of the present invention to provide an apparatus for quantizing a spectral envelope with noise robustness, which shows a satisfactory performance under a clean environment or a background noise environment when no channel error is generated and under a channel noise environment when a channel error is generated, by efficiently preventing the influence of the channel error from spreading so that the channel error affects only several frames, and a method therefor.

It is another objective of the present invention to provide an apparatus for quantizing the spectral envelope with noise robustness, which shows a satisfactory performance under various background noise environments, and a method therefor.

Accordingly, to achieve the first objective, there is provided a spectral envelope quantizing apparatus with noise robustness for representing a spectral envelope of speech by a minimum number of bits for the optimal coding of a speech signal, comprising a line spectrum frequencies (LSFs) input portion for converting linear predictive coding coefficients extracted from the speech into Nth order line spectrum frequencies coefficients and inputting the coefficients as the LSFs of a current frame, a linked split-vector quantizing portion for dividing the LSFs into a predetermined number of linked sub-vectors and quantizing the sub-vectors, a predictive linked split-vector quantizing portion for obtaining the difference between the LSFs and the LSFs of a previous frame and vector-quantizing the difference, and an error selector for comparing the error values of the LSFs quantized in the linked split-vector quantizing portion and the predictive linked split-vector quantizing portion, selecting the codebook index of the quantized LSFs having the smaller error value, and outputting the selected codebook index together with a mode bit.

Also, there is provided a spectral envelope quantizing method with noise robustness for representing a spectral envelope of speech by a minimum number of bits for the optimal coding of a speech signal, comprising the steps of inputting the LSFs of a current frame, dividing the LSFs into a predetermined number of linked sub-vectors and linked split-vector-quantizing the sub-vectors and, at the same time, obtaining the difference between the LSFs and the LSFs of a previous frame and predictive linked split-vector-quantizing the difference, comparing the error values of the linked split-vector quantized LSFs with those of the predictive split-vector quantized LSFs, and selecting the codebook index of the quantized LSFs having the smaller error value and outputting the selected codebook index together with a mode bit.

To achieve the second objective, there is provided a spectral envelope quantizing apparatus with noise robustness for representing a spectral envelope of speech by a minimum number of bits for the optimal coding of a speech signal, comprising an LSFs input portion for converting linear predictive coding coefficients extracted from the speech into Nth order LSF coefficients and inputting the coefficients as the LSFs of a current frame, a clean environment quantizing portion for dividing the LSFs into a predetermined number of linked sub-vectors and vector-quantizing the sub-vectors under a clean speech environment, a babble noise quantizing portion for dividing the LSFs into the predetermined number of linked sub-vectors and vector-quantizing the sub-vectors under a babble noise environment, a car noise quantizing portion for dividing the LSFs into the predetermined number of linked sub-vectors and vector-quantizing the sub-vectors under a car noise environment, a predictive linked split-vector quantizing portion for obtaining the difference between the LSFs and the LSFs of a previous frame and vector-quantizing the difference under all the environments, and an error selector for comparing the error values of the LSFs quantized in the clean environment quantizing portion, the babble noise quantizing portion, the car noise quantizing portion, and the predictive linked split-vector quantizing portion to each other, selecting the codebook index of the quantized LSF having the smallest error value, and outputting the selected codebook index together with a mode bit.

Also, there is provided a spectral envelope quantizing method with noise robustness for representing the spectral envelope of speech by a minimum number of bits for the optimal coding of a speech signal, comprising the steps of inputting the LSFs of a current frame, dividing the LSFs into a predetermined number of linked sub-vectors and linked split-vector-quantizing the sub-vectors through codebooks trained under a clean speech environment, a babble noise environment, and a car noise environment and, at the same time, obtaining a difference between the LSFs and the LSFs of a previous frame through codebooks trained under all the circumstances and predictive split-vector-quantizing the sub-vectors, comparing the error values of the linked split-vector quantized LSFs with those of the predictive split-vector quantized LSFs, and selecting the codebook index of the quantized LSF having the smallest error value and outputting the selected codebook index together with a mode bit.

BRIEF DESCRIPTION OF THE DRAWING(S)

The above objective(s) and advantage(s) of the present invention will become more apparent by describing in detail a preferred embodiment thereof with reference to the attached drawing(s) in which.

DESCRIPTION OF THE PREFERRED EMBODIMENT(S)

Hereinafter, the structure and operation of a spectral envelope quantizer with noise robustness according to the present invention, and a quantizing method, will be described as follows with reference to the attached drawings.

Figure 1:
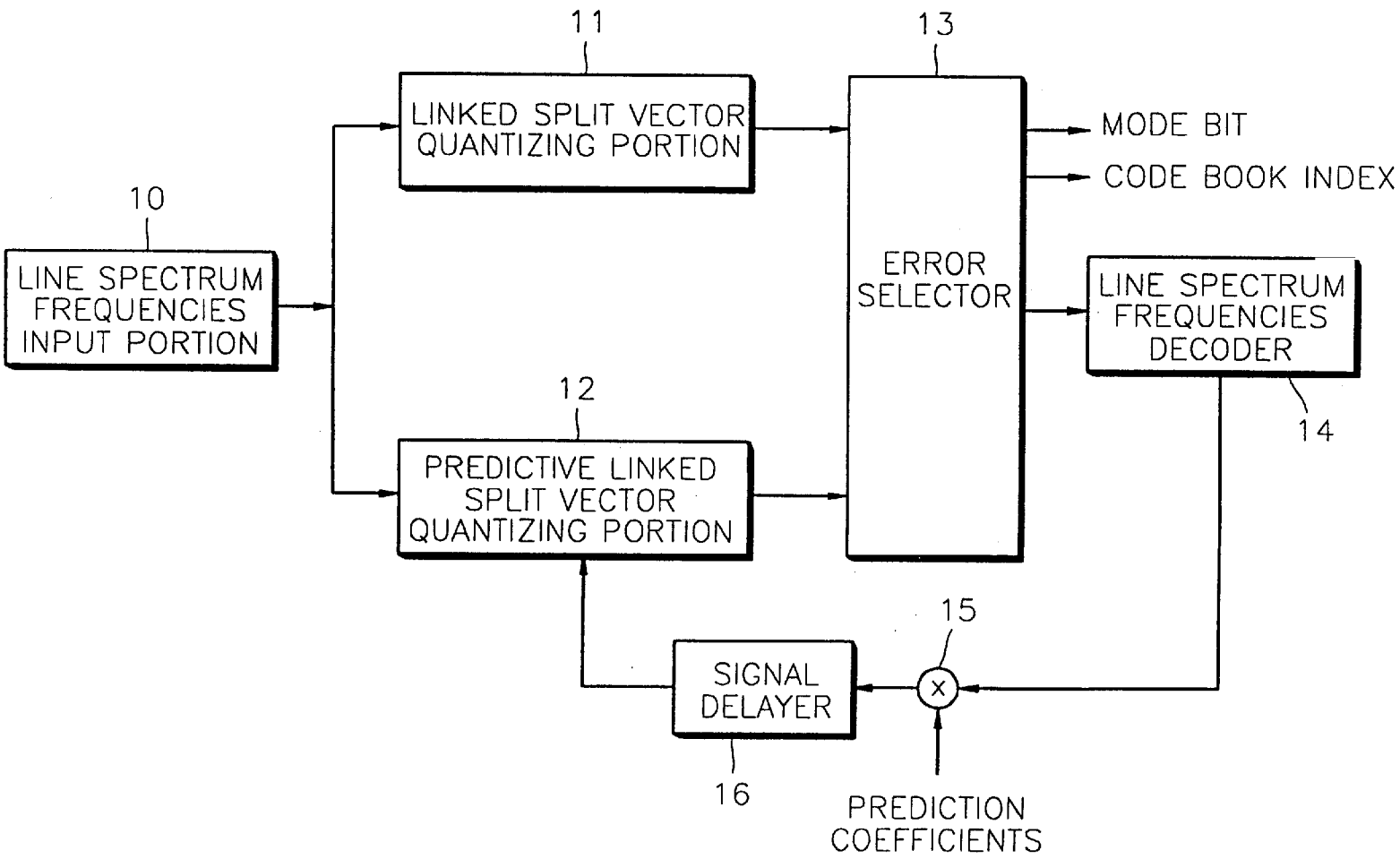
FIG. 1 is a block diagram of a preferred embodiment of a spectral envelope quantizer with noise robustness according to the present invention.

Referring to FIG. 1, a spectral envelope quantizer with noise robustness according to a preferred embodiment of the present invention includes a line spectrum frequencies (LSFs) input portion 10, a linked split-vector quantizing portion (LSVQ) 11, a predictive linked split-vector quantizing portion (PLSVQ) 12, an error selector 13, an LSF decoder 14, a multiplication controller 15, and a signal delayer 16.

In order to achieve the first objective of the present invention, the LSVQ and PLSVQ, having higher performance than the conventional SVQ and PSVQ, are used. Also, a switched-prediction method of using the LSVQ and the PLSVQ adjusted to a situation is used, to effectively prevent the influence of a channel error from spreading. The SVQ and the PLSVQ are designed to be robust with background noise.

The LSF input portion 10 converts linear predictive coding (LPC) coefficients extracted from speech into Nth order LSFs and inputs them as the LSFs of the present frame in units of a frame. The linked split-vector quantizing portion 11 and the predictive linked split-vector quantizing portion 12 divide the LSFs input through the LSF input portion 10 into a predetermined number of linked sub-vectors, and vector-quantize the sub-vectors. At this time, the predictive linked split-vector quantizing portion 12 obtains the difference between the LSFs and the LSFs of a previous frame, and vector-quantizes the difference.

The error selector 13 obtains the codebooks of the LSFs quantized in the linked split-vector quantizing portion 11 and the predictive linked split-vector quantizing portion 12, respectively. At this time, the error selector 13 selects one of the codebooks of the linked split-vector quantizing portion 11 and the predictive linked split-vector quantizing portion 12, using a weighted Euclidean distance measure. To do this, the error selector 13 compares the error values of the quantized LSFs with each other, selects the codebook index of the quantized LSF having the smaller error value, and transfers the selected codebook index to a predetermined speech receiver (not shown) with a mode bit represented by one bit.

Therefore, the mode bit transfers information on whether the linked split-vector quantizing portion 11 or the predictive linked split-vector quantizing portion 12 is used. A codebook index concerned with the mode bit is also transferred. Here, the mode bit is one bit, either 0 or 1. The mode bit is an identification bit for identifying which one is used among the linked split-vector quantizing portion 11 and the predictive linked split-vector quantizing portion 12 in the receiver for receiving the speech.

Also, the LSF decoder 14 receives the codebook index and the mode bit from the error selector 13 and decodes the LSFs quantized by the concerned codebook index, in order to allow the information of the previous frame to be used in a predictive linked split-vector quantizing portion 12. The multiplication controller 15 multiplies the LSFs decoded in the LSF decoder 14 by predetermined prediction coefficients.

The signal delayer 16 stores the value (the decoded LSFs×the prediction coefficients) multiplied by the multiplication controller 15, and feeds back the operation value delayed by one frame to the predictive linked split-vector quantizing portion 12 when the LSFs of the next frame are input from the LSF input portion 10.

Figure 2:
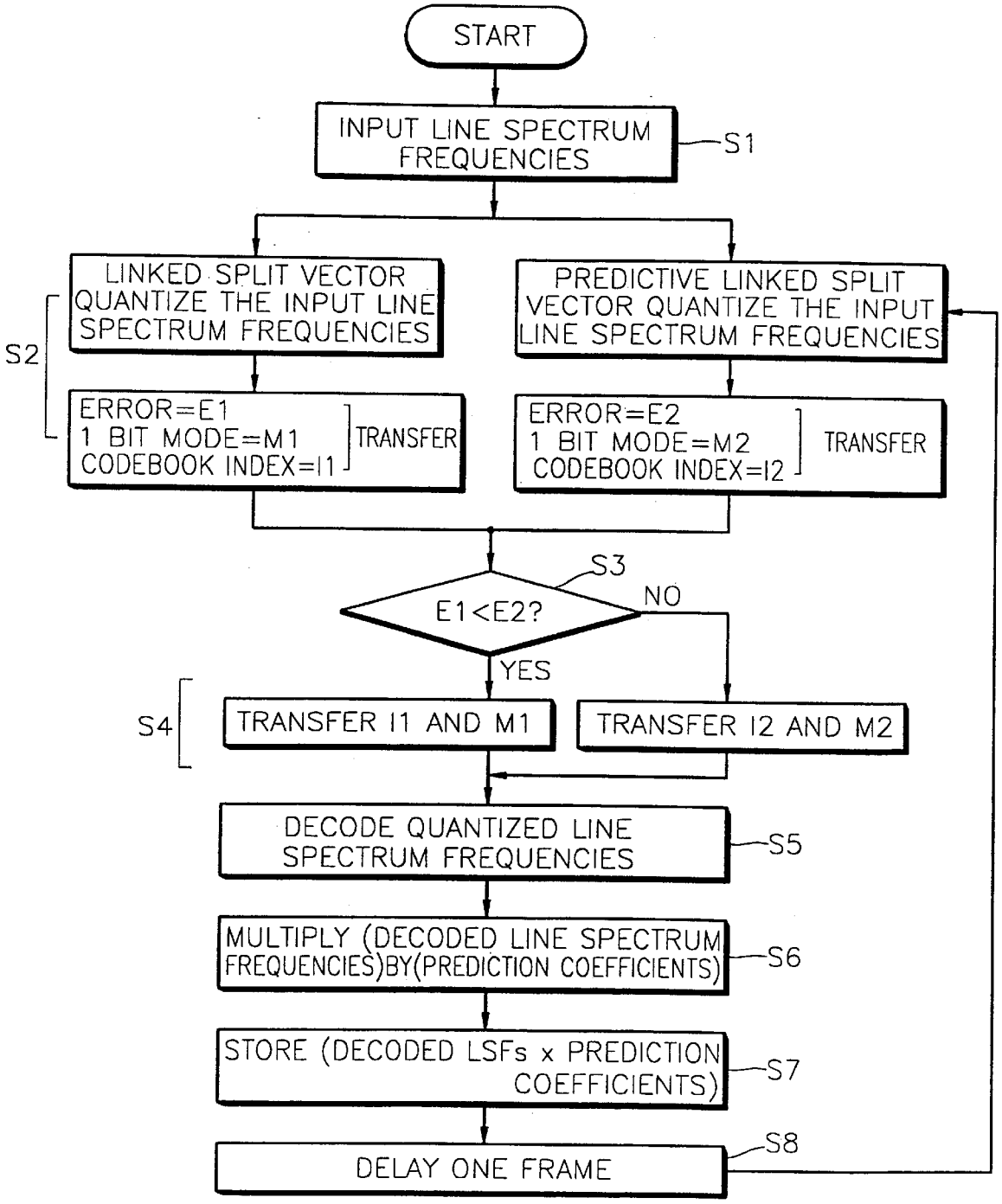
FIG. 2 is a flowchart describing a spectral envelope quantizing method with noise robustness according to the present invention, performed by the apparatus shown in FIG. 1.

Referring to FIG. 2, a spectral envelope quantizing method with noise robustness according to a preferred embodiment of the present invention, performed by the apparatus shown in FIG. 1, will be described.

The LSFs of the current frame are input through the LSF input portion 10 (S1). The input LSFs are divided into a predetermined number of linked sub-vectors and are linked split-vector-quantized through the linked split-vector quantizing portion 11. At the same time, the difference between the input LSFs and the LSFs of the previous frame is obtained and is vector-quantized through the predictive linked split-vector quantizing portion 12 (S2). The error values of the codebooks quantized through the linked split-vector quantizing portion 11 and the predictive linked split-vector quantizing portion 12 are compared in the error selector 13 (S3). A codebook index (I1 or I2) having the smaller error is selected after comparing the error values to each other and the selected codebook index (I1 or I2) is transferred to a predetermined speech receiver with one mode bit (M1 or M2).

The LSFs quantized by the codebook index (I1 or I2) corresponding to the mode bit (M1 or M2) selected and transferred from the error selector 13 through the LSF decoder 14 are decoded (S5). The LSFs decoded in the LSF decoder 14 are multiplied by the prediction coefficients in the multiplication controller 15 (S6). The multiplied value (the decoded LSFs×the prediction coefficients) is stored, for the predictive linked split-vector quantizing portion 12 of the next frame (S7). The stored value is delayed by one frame until the LSFs of the next frame are input from the LSF input portion 10 through the signal delayer 16 (S8). Finally, the delayed value is used in the step S2.

Hereinafter, the operation principle of the error selector 13 will be described in detail.

Assuming that one frame is comprised of tenth order LSFs, the tenth order LSFs are divided into three vectors, i.e., lower, middle, and upper vectors and are presented as follows.

$$\{(\omega_1,\omega_2,\omega_3)(\omega_4,\omega_5,\omega_6)(\omega_7,\omega_8,\omega_9,\omega_{10})\}$$

A quantizer in which the interframe correlation of the LSFs is used has the following two shortcomings. (1) when a channel error is generated in an arbitrary frame, the influence of the error spreads to the final frame. (2) when the spectral change between two continuous frames is large, the interframe correlation is small. Accordingly, the performance may be lower than a static quantizer in which the correlation is not used.

Such problems can be solved by selecting one among the static quantizer and the dynamic quantizer according to the situation. Namely, when the spectral change of an arbitrary frame is small, the dynamic quantizer, which uses the interframe correlation, is used. When the spectral change is large, the static quantizer, which uses only the correlation within a frame, is used.

The quantizer is selected using the following weighted Euclidean distance measure.

$$d(\omega,\overline{\omega}) = \sum_i v(i)[\omega_i - \overline{\omega}_i]^2$$

wherein, $\omega$ is an original LSF before quantization. $\overline{\omega}$ is the value of the code vector kept in the codebook after quantization. $\omega_i$ and $\overline{\omega_i}$ are ith LSFs of $\omega$ and $\overline{\omega}$, respectively.

The variable weighted function of the ith LSFs is as follows.

$$v(i) = \frac{1}{\min[\omega_i - \omega_{i-1}, \omega_{i+1} - \omega_i]}, \quad i = 1, 2, \ldots, 10$$

wherein $$\omega_0 = 0 \quad \text{and} \quad \omega_{11} = \frac{\pi}{2}.$$

This function has weight on formant frequencies. Accordingly, speech quality is improved when the function is used.

As mentioned above, it is possible to restrict the spread of the channel error within only several frames using the switched prediction method. Namely, upon switching from the dynamic quantizer to the static quantizer, the channel error no longer spreads.

The present invention uses the LSVQ as the static quantizer and the PLSVQ as the dynamic quantizer, and therefore is named a switched predictive linked split-vector quantizer (SP-LSVQ). This can be compared with the conventional switched predictive split-vector quantizer (SP-SVQ) in which the SVQ is used as the conventional static quantizer and the PSVQ is used as the conventional dynamic quantizer.

TABLE 1

Comparison of conventional quantizers under clean speech environment

| Quantizer | bits/frame | Avg. SD (dB) | SD outliers (%) 2–4 dB | SD outliers (%) >4 dB |
|---|---|---|---|---|
| SVQ | 24 | 0.97 | 6.74 | 0.59 |
| LSVQ | | 0.89 | 5.66 | 0.09 |
| PSVQ | 21 | 0.95 | 6.10 | 0.20 |
| PLSVQ | | 0.94 | 6.12 | 0.15 |

TABLE 2

Comparison of SP-SVQ and SP-LSVQ in 19 bits/frame

| Quantizer | Environment | Avg. SD (dB) | SD outliers (%) 2–4 dB | SD outliers (%) >4 dB |
|---|---|---|---|---|
| SP-SVQ | clean | 0.98 | 7.21 | 0.07 |
| | babble | 1.23 | 6.30 | 0.05 |
| | car | 1.31 | 6.09 | 0.02 |
| SP-LSVQ | clean | 0.96 | 6.36 | 0.04 |
| | babble | 1.20 | 5.52 | 0.02 |
| | car | 1.28 | 5.08 | 0.01 |

Table 1 shows the performances of conventional quantizers. From the table 1, it is noted that the average spectral distortion (Avg. SD) values of the LSVQ and the PLSVQ are lower than those of the SVQ and the PSVQ, respectively. In table 2, the performance of the SP-SVQ is compared with that of the SP-LSVQ, at 19 bits/frame.

As shown in tables 1 and 2, the SP-LSVQ at 19 bits/frame shows a higher performance than the SVQ at 24 bits/frame, under a clean speech environment. The SP-LSVQ at 19 bits/frame shows a higher performance than the PSVQ at 21 bits/frame, the PLSVQ at 21 bits/frame, and the SP-SVQ at 19 bits/frame. Also, the SP-LSVQ at 19 bits/frame shows a higher performance than the SP-SVQ under babble noise and car noise environments.

As mentioned above, the SP-LSVQ shows satisfactory performance at 19 bits/frame under the clean speech environment. However, three to four more bits are required in order to obtain satisfactory performance under a background noise environment.

The second objective of the present invention is to solve the above problems, which will be described as follows.

In the case of the conventional quantizer in which the codebooks are trained by only clean speech, too many code vectors are formed in a section in which many LSF vectors are distributed. However, few code vectors are formed in a section in which the LSF vectors are sparsely distributed. Therefore, when LSFs in a sparsely distributed section are input to the quantizer, the codebook generates a big error. This problem is solved by collecting data under various background noise environments and training the codebook.

Figure 3:
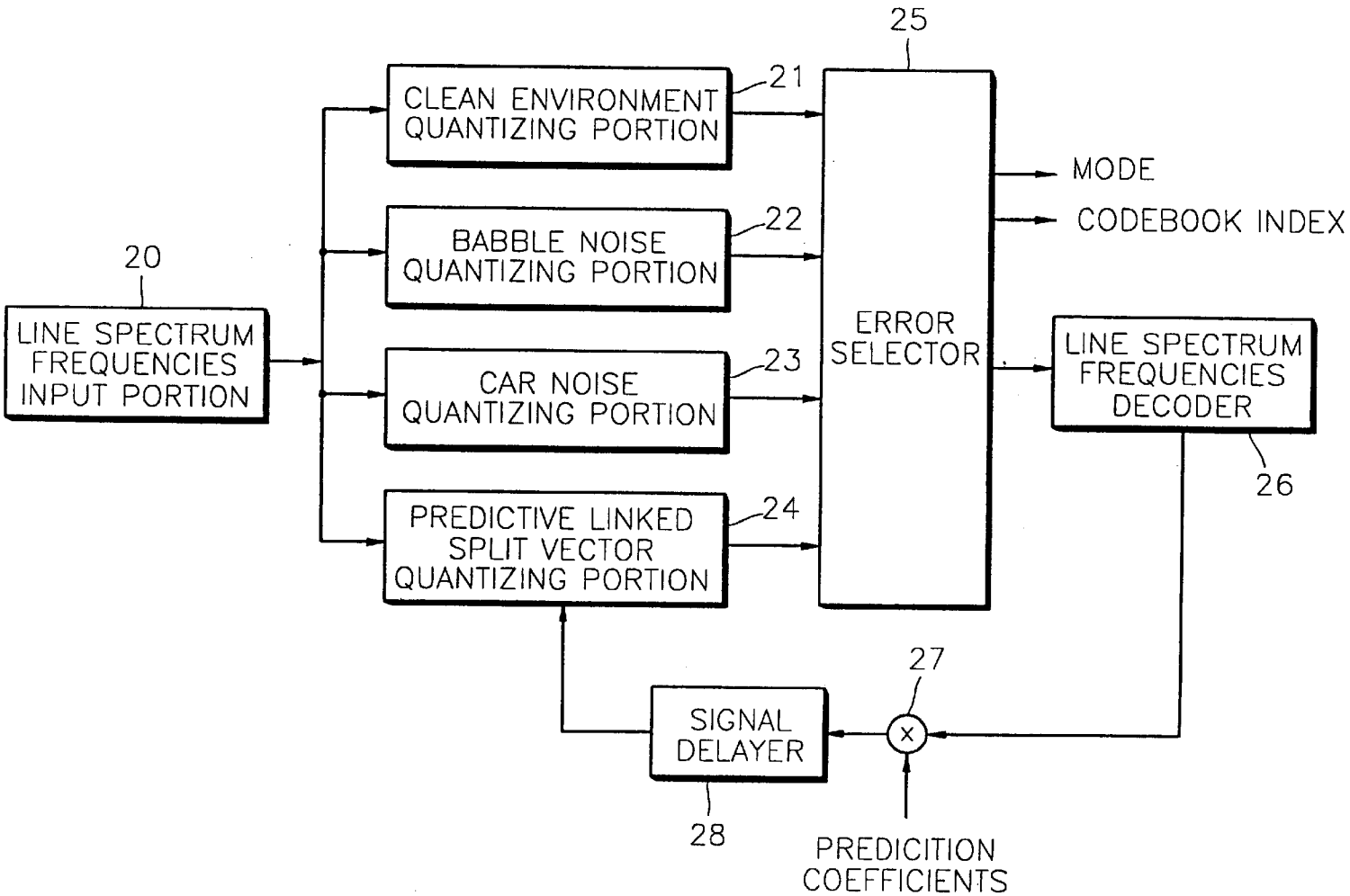
FIG. 3 is a block diagram of another preferred embodiment of a spectral envelope quantizer with noise robustness according to the present invention.

Referring to FIG. 3, a spectral envelope quantizer with noise robustness according to another preferred embodiment of the present invention includes an LSF input portion 20, a clean environment quantizer 21, a babble noise quantizer 22, a car noise quantizer 23, a predictive linked split-vector quantizing portion 24, an error selector 25, an LSF decoder 26, a multiplication controller 27, and a signal delayer 28.

The LSF input portion 20 converts the LPC coefficients extracted from the speech into Nth order LSF coefficients and inputs them as the LSFs of the current frame in units of a frame. At this time, the LSFs are selected through a clean environment quantizer 21 in which 43.4% of frames are trained by only clean speech under the clean speech environment. Also, 46.6% of frames are selected by the predictive linked split-vector quantizing portion 24. The remaining frames are selected by the different two codebooks of the babble noise quantizer 22 and the car noise quantizer 23. Namely, the section in which the LSFs are sparsely distributed is compensated for under the clean speech environment when the two codebooks trained under different environments quantize 10.0% of the frames.

The clean environment quantizer 21 trained by only clean speech, the babble noise quantizer 22 trained by only speech with babble noise, the car noise quantizer 23 trained by only speech with car noise, and the predictive linked split-vector quantizing portion 24, trained by the above three kinds of data, which plays an important role in a section in which a spectral change is small under any environment, respectively vector-quantize the LSFs input through the LSF input portion 20. At this time, the predictive linked split-vector quantizing portion 24 obtains the difference between the input LSFs and the LSFs of the previous frame and vector-quantizes the difference.

The error selector 25 compares the error values with respect to the codebooks of the LSFs quantized in the above four quantizers, respectively using the weighted Euclidean distance measure. By doing so, the codebook index having the smallest error value is selected. The type of the codebook is represented by two bits. Also, the mode bit of two bits for identifying which one is used among the three LSVQs (the clean environment quantizer 21, the babble noise quantizer 22, and the car noise quantizer 23) and the PLSVQ (the predictive linked split-vector quantizing portion 24) is transferred to a predetermined speech receiver (not shown) with a concerned codebook index.

Also, the LSFs decoder 26 receives a code index and a mode bit from the error selector 25 and decodes the LSFs quantized by the concerned codebook index in order to allow the information of the previous frame to be used in the predictive linked split-vector quantizer 24. The multiplication controller 27 multiplies the LSFs decoded in the LSFs decoding portion 26 by predetermined prediction coefficients.

The signal delayer 28 stores the value (the decoded LSFs×the prediction coefficients) multiplied through the multiplication controller 27 and outputs the operation value (the decoded LSFs×the prediction coefficients) delayed by one frame to the predictive linked split-vector quantizing portion 24 when the LSFs of the next frame are input from the LSFs input portion 20.

Figure 4:
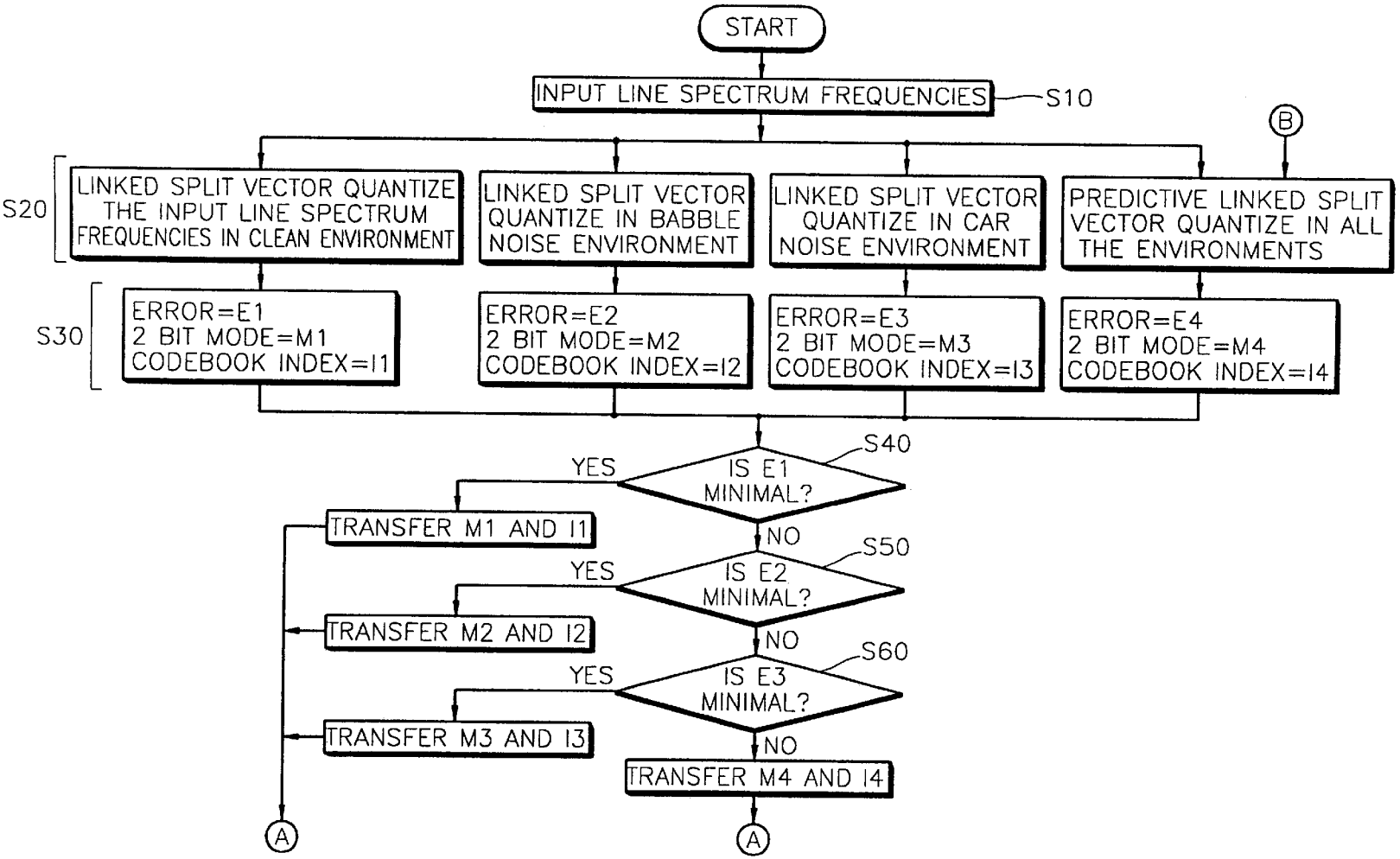
FIGS. 4 and 4A show a flowchart describing a spectral envelope quantizing method with noise robustness according to the present invention, performed by the apparatus shown in FIG. 3.
Figure 4A:
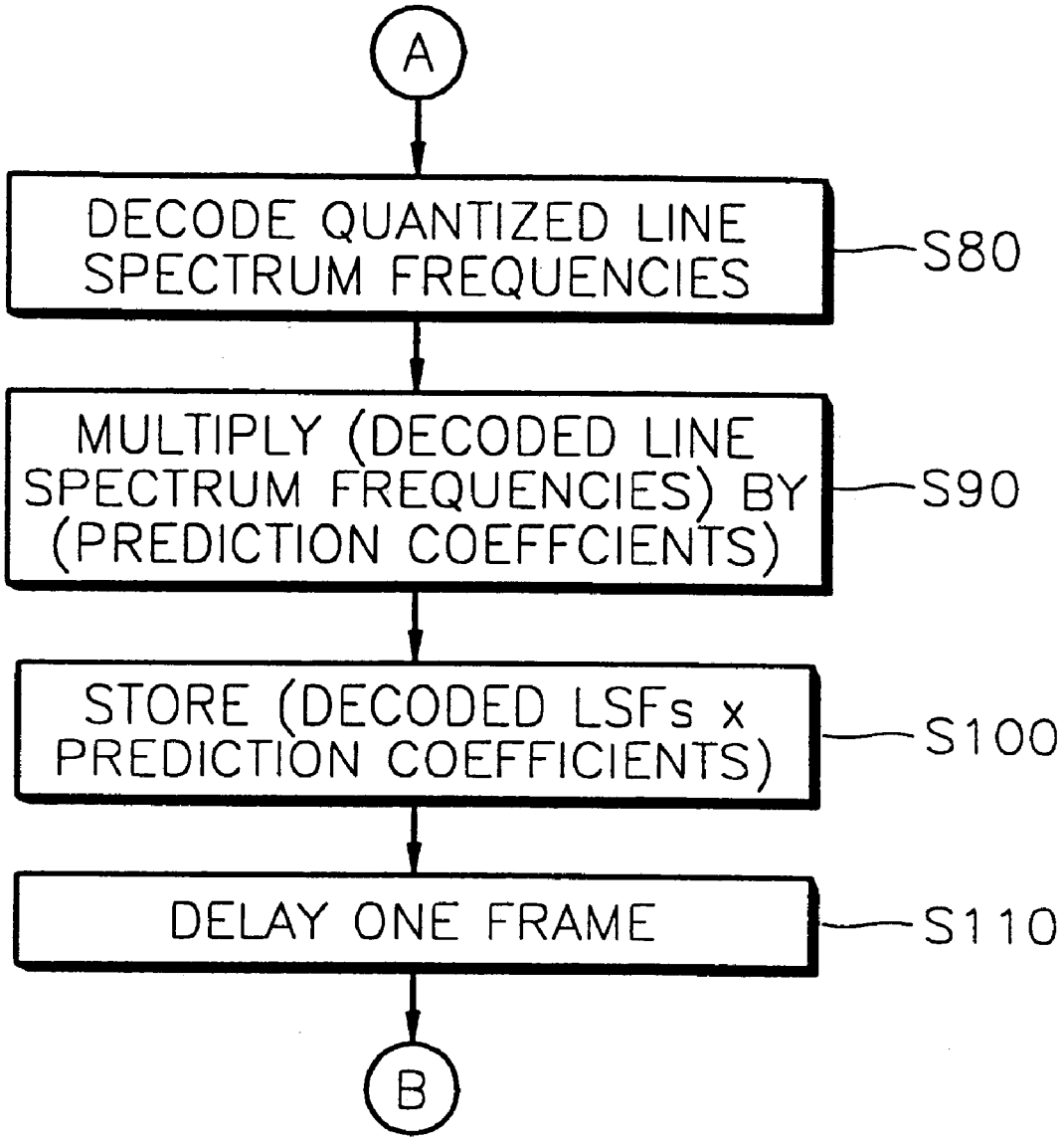

Referring to FIGS. 4 and 4A, the spectral envelope quantizing method with noise robustness according to another preferred embodiment of the present invention, performed by the apparatus shown in FIG. 3, will be described.

The LSFs of the current frame are input through the LSF input portion 20 (S10). The input LSFs are vector-quantized through the clean environment quantizing portion 21 trained by only clean speech, the babble noise quantizing portion 22 trained by only speech with babble noise, the car noise quantizing portion 23 trained by only speech with car noise, and the predictive linked split-vector quantizing portion 24 trained by the above three kinds of data, which plays an important role in a section in which a spectral change is small under any environments (S20).

The error values of the codebooks respectively quantized through the error selector 25 are compared with each other (S30). When the error value E1 of the clean environment quantizing portion 21 is minimal, the codebook index I1 of the clean environment quantizing portion 21 is selected and the selected codebook index I1 is transferred in the two bit mode M1 (S40). When the error value E1 of the clean environment quantizing portion 21 is not minimal, it is determined whether the error value E2 of the babble noise quantizing portion 22 is minimal. When the error value E2 of the babble noise quantizing portion 22 is minimal, the codebook index I2 of the babble noise quantizing portion 22 is selected and the selected codebook index I2 is transferred in the two bit mode M2 (S50). When the error value E2 of the babble noise quantizing portion 22 is not minimal, it is determined whether the error value E3 of the car noise quantizing portion 23 is minimal. When the error value E3 of the car noise quantizing portion 23 is minimal, the codebook index I3 of the car noise quantizing portion 23 is selected and the selected codebook index I3 is transferred in the two bit mode M3 (S60). When the error value E3 of the car noise quantizing portion 23 is not minimal, it is determined whether the error value E4 of the predictive linked split-vector quantizing portion 24 is minimal. When the error value E4 of the predictive linked split-vector quantizing portion 24 is minimal, the codebook index I4 of the predictive linked split-vector quantizing portion 24 is selected and the selected codebook index I4 is transferred in the two bit mode M4 (S70).

The LSFs quantized by the codebook index (one among I1, I2, I3, and I4) corresponding to the mode bit (one among M1, M2, M3, and M4) selected and transferred from the error selector 25 are decoded by the LSFs decoder 26 (S80). The LSFs decoded in the LSFs decoder 26 are multiplied by the prediction coefficients in the multiplication controller 27 (S90). The multiplied value (the decoded LSFs×the prediction coefficients) is stored for the predictive linked split-vector quantizing portion 24 of the next frame (S100). The stored value is delayed by one frame by the signal delayer 28 until the LSFs of the next frame are input from the LSFs input portion 20 (S110). Finally, the delayed value is used in the step S20.

A speech database of NATC (NTT Advanced Technology Cooperation) is used in order to measure the performance of the quantizing apparatus according to the present invention.

In the Korean speech of the NATC database used as training data in the present experiment, each of four men and four women pronounces twelve different sentences, at eight seconds per one sentence. The database is composed of speech data of 2,304 seconds (8 persons×12 sentences×8 seconds×3 environments=2,304 seconds) in which the clean speech environment, the babble noise speech environment, and the car noise speech environment are applied to each sentence.

For a fair estimation, the English speech of the NATC database is also used as a test speech, in which each of four men and four women pronounces twelve different sentences, at eight seconds per one sentence. The data base is composed of speech data of 2,304 seconds (8 persons×12 sentences×8 seconds×3 environments=2,304 seconds) in which the clean speech environment, the babble noise speech environment, and the car noise speech environment are applied to each sentence.

The speech data goes through tenth order LPC analysis based on an autocorrelation method per 20 ms and is converted into the LSFs. The LSFs are divided into three sub-vectors having 3, 3, 4 dimensions for an effective quantization. The estimation of performance is performed using a spectral distortion (SD) measuring method.

The SD of the ith frame is as follows.

$$SD_i = \sqrt{\frac{1}{b-a}\sum_{j=a}^{b}\left[10\log_{10}|P_j|^2 - 10\log_{10}|\overline{P}_j|^2\right]^2}$$

wherein, $p_j$ represents the power spectrum of the original LSFs and $\overline{P}_j$ represents the power spectrum of the quantized LSFs. Also, a and b respectively represent sections in which the power spectrums are compared. 125 Hz is selected as a, adjusting to the characteristics of human ears. 3,400 Hz is selected as b.

Table 3 shows the performance of a noise robust-switched predictive linked split-vector quantizer (NR-SP-LSVQ) at 20 bits/frame according to the second objective of the present invention.

TABLE 3

Comparison of performances of SP-SVQ and NR-SP-LSVQ at 20 bits/frame

| Quantizer | Environment | Avg. SD (dB) | SD outliers (%) 2-4 dB | SD outliers (%) >4 dB |
|---|---|---|---|---|
| SP-SVQ | clean | 0.92 | 4.96 | 0.05 |
| | babble | 1.16 | 4.26 | 0.03 |
| | car | 1.23 | 3.96 | 0.02 |
| NR-SP-LSVQ | clean | 0.91 | 4.69 | 0.03 |
| | babble | 1.03 | 3.90 | 0.02 |
| | car | 1.00 | 2.84 | 0.00 |

Referring to table 3, the Avg. SD of the SP-SVQ far exceeds 1 dB at 20 bits/frame. The Avg. SD of the NR-SP-LSVQ is near 1 dB. It is assumed that Avg. SD of 1 dB can be obtained at 19 bits/frame since the NR-SP-LSVQ shows better performance than that of the SP-SVQ with respect to clean speech.

Also, since the static quantizer occupies more parts than the SP-SVQ, the spread of the channel error is more effectively intercepted. As a result of an experiment, it is noted that the SP-SVQ uses the static quantizer 47.9% of the time and that the NR-SP-LSVQ uses the static quantizer 53.4% of the time. Therefore, as shown in table 3, the NR-SP-LSVQ shows a higher performance than the SP-SVQ under the clean, background noise, and channel noise environments.

As mentioned above, the spectral envelope quantizing apparatus and method with noise robustness according to the present invention shows high performance under the clean speech and background noise environments when no channel error is generated, at 20 bits/frame, and shows noise robustness under the background noise environment and the channel noise environment by effectively intercepting the spread of the channel error so that the channel error is spread to only several frames, when the channel error is generated.

What is claimed is:

1. A spectral envelope quantizing apparatus with noise robustness for representing a spectral envelope of speech by a minimum number of bits for the optimal coding of a speech signal, comprising:

a line spectrum frequencies (LSFS) input portion for converting linear predictive coding coefficients extracted from the speech into Nth order line spectrum frequencies coefficients and inputting the coefficients as the LSFs of a current frame;

a linked split-vector quantizing portion for dividing the LSFs into a predetermined number of linked sub-vectors and quantizing the sub-vectors;

a predictive linked split-vector quantizing portion for obtaining the difference between the LSFs of a current frame and the LSFs of a previous frame and vector-quantizing the difference; and an error selector for comparing the error values of the LSFs quantized in the linked split-vector quantizing portion and the predictive linked split-vector quantizing portion, selecting the codebook index of the quantized LSFs having the smaller error value, and outputting the selected codebook index together with a mode bit.

2. The spectral envelope quantizing apparatus of claim 1, further comprising:

a line spectrum frequency decoder for receiving the codebook index and the mode bit and decoding the quantized LSFs;

a multiplication controller for multiplying the LSFs decoded in the line spectrum frequency decoder by predetermined predictive coefficients; and a signal delayer for storing the value multiplied by the multiplication controller, delaying the value by the input time of a frame, and outputting the value to the predictive linked split-vector quantizing portion.

3. A spectral envelope quantizing method with noise robustness for representing a spectral envelope of speech by a minimum number of bits for the optimal coding of a speech signal, comprising the steps of:

inputting the LSFs of a current frame;

dividing the LSFs into a predetermined number of linked sub-vectors and linked split-vector-quantizing the sub-vectors and, at the same time, obtaining the difference between the LSFs and the LSFs of a previous frame and predictive linked split-vector-quantizing the difference;

comparing the error values of the linked split-vector quantized LSFs with those of the predictive split-vector quantized LSFs; and selecting the codebook index of the quantized LSFs having the smaller error value and outputting the selected codebook index together with a mode bit.

4. The method of claim 3, further comprising the steps of:

receiving the codebook index and the mode bit and decoding the quantized LSFs;

multiplying the decoded LSFs by predetermined prediction coefficients;

storing the multiplied value for the predictive linked split-vector quantization of the next frame; and delaying the stored value by the input time of a frame until the LSFs of the next frame are input.

5. A spectral envelope quantizing apparatus with noise robustness for representing a spectral envelope of speech by a minimum number of bits for the optimal coding of a speech signal, comprising:

an LSFs input portion for converting linear predictive coding coefficients extracted from the speech into Nth order LSF coefficients and inputting the coefficients as the LSFs of a current frame;

a clean environment quantizing portion for dividing the LSFs into a predetermined number of linked sub-vectors and vector-quantizing the sub-vectors under a clean speech environment;

a babble noise quantizing portion for dividing the LSFs into the predetermined number of linked sub-vectors and vector-quantizing the sub-vectors under a babble noise environment;

a car noise quantizing portion for dividing the LSFs into the predetermined number of linked sub-vectors and vector-quantizing the sub-vectors under a car noise environment;

a predictive linked split-vector quantizing portion for obtaining the difference between the LSFs and the LSFs of a previous frame and vector-quantizing the difference under all the environments; and an error selector for comparing the error values of the LSFs quantized in the clean environment quantizing portion, the babble noise quantizing portion, the car noise quantizing portion, and the predictive linked split-vector quantizing portion to each other, selecting the codebook index of the quantized LSF having the smallest error value, and outputting the selected codebook index together with a mode bit.

6. The spectral envelope quantizing apparatus of claim 5, further comprising:

an LSF decoder for receiving the codebook index and the mode bit and decoding the quantized LSFs;

a multiplication controller for multiplying the LSFs decoded in the LSF decoder by predetermined prediction coefficients; and a signal delayer for storing the value multiplied by the multiplication controller, delaying the value by the input time of one frame, and outputting the value to the predictive linked split-vector quantizing portion.

7. A spectral envelope quantizing method with noise robustness for representing the spectral envelope of speech by a minimum number of bits for the optimal coding of a speech signal, comprising the steps of:

inputting the LSFs of a current frame;

dividing the LSFs into a predetermined number of linked sub-vectors and linked split-vector-quantizing the sub-vectors through codebooks trained under a clean speech environment, a babble noise environment, and a car noise environment and, at the same time, obtaining a difference between the LSFs and the LSFs of a previous frame through codebooks trained under all the circumstances and predictive split-vector-quantizing the sub-vectors;

comparing the error values of the linked split-vector quantized LSFs with those of the predictive split-vector quantized LSFs; and selecting the codebook index of the quantized LSF having the smallest error value and outputting the selected codebook index together with a mode bit.

8. The method of claim 7, further comprising the steps of:

receiving the codebook index and the mode bit and decoding the quantized LSF;

multiplying the decoded LSFs by a predetermined prediction coefficient;

storing the multiplied value for the predictive linked split-vector quantization of the next frame; and delaying the stored value by the input time of one frame until the LSFs of the next frame are input.

* * * * *